US008505774B2

(12) United States Patent
Nimmo et al.

(10) Patent No.: US 8,505,774 B2
(45) Date of Patent: Aug. 13, 2013

(54) FLUID DELIVERY DEVICE

(75) Inventors: Chris Nimmo, Brow Cottage (GB); Olivier Bertaud, Boulogne (FR)

(73) Assignee: Power Container Corp., Somerset, NJ (US)

( * ) Notice: Subject to any disclaimer, the term of this patent is extended or adjusted under 35 U.S.C. 154(b) by 844 days.

(21) Appl. No.: 11/610,842

(22) Filed: Dec. 14, 2006

(65) Prior Publication Data

US 2007/0267437 A1 Nov. 22, 2007

Related U.S. Application Data

(60) Provisional application No. 60/714,528, filed on Dec. 16, 2005.

(30) Foreign Application Priority Data

Feb. 15, 2005 (FR) ..... 05 01511
Nov. 16, 2005 (FR) ..... 05 11614

(51) Int. Cl.
*B65D 83/62* (2006.01)

(52) U.S. Cl.
USPC ..... 222/94; 222/95; 222/105; 222/386.5; 222/402.1

(58) Field of Classification Search
USPC ..... 222/94, 95, 105, 386.5, 402.1
See application file for complete search history.

(56) References Cited

U.S. PATENT DOCUMENTS 3,731,854 A 5/1973 Casey
4,423,829 A 1/1984 Katz
4,865,224 A 9/1989 Streck
5,111,971 A 5/1992 Winer
5,232,126 A * 8/1993 Winer ..... 222/95
5,263,519 A * 11/1993 Reyner ..... 141/20
5,265,765 A 11/1993 Maier (Continued)

FOREIGN PATENT DOCUMENTS

DE 7244369 E 12/1972
EP 0 105 537 8/1983

(Continued)

OTHER PUBLICATIONS

International Search Report from International Application No. PCT/IB2007/000342.
International Search Report from International Application No. PCT/FR2006/000338.

*Primary Examiner* — J. Casimer Jacyna
(74) *Attorney, Agent, or Firm* — McDonnell Boehnen Hulbert & Berghoff LLP

(57) ABSTRACT

Device adapted to deliver fluids, in particular medicines, under pressure, comprising a receptacle 1 of variable volume in a form or shape of a pouch or flexible container of general cylindrical shape with exclusively longitudinal pleats 2 containing the fluid under pressure to be delivered and equipped with an actuator C permitting to open a valve 15*a*, 15*b*, to enable the aforementioned fluid to be delivered, the whole being located inside a receptacle 4 capable of resisting to an elevated internal pressure, the internal volume of this last receptacle comprised between its wall and the receptacle of variable volume being filled with a neutral gas under a pressure sufficient to exert on the receptacle of variable volume a pneumatic constraint sufficient to permit the delivery of the therein contained fluid when the above-said valve permitting the said delivery is operated by the aforementioned actuator C.

13 Claims, 4 Drawing Sheets

(56) References Cited

U.S. PATENT DOCUMENTS

Figure 1:
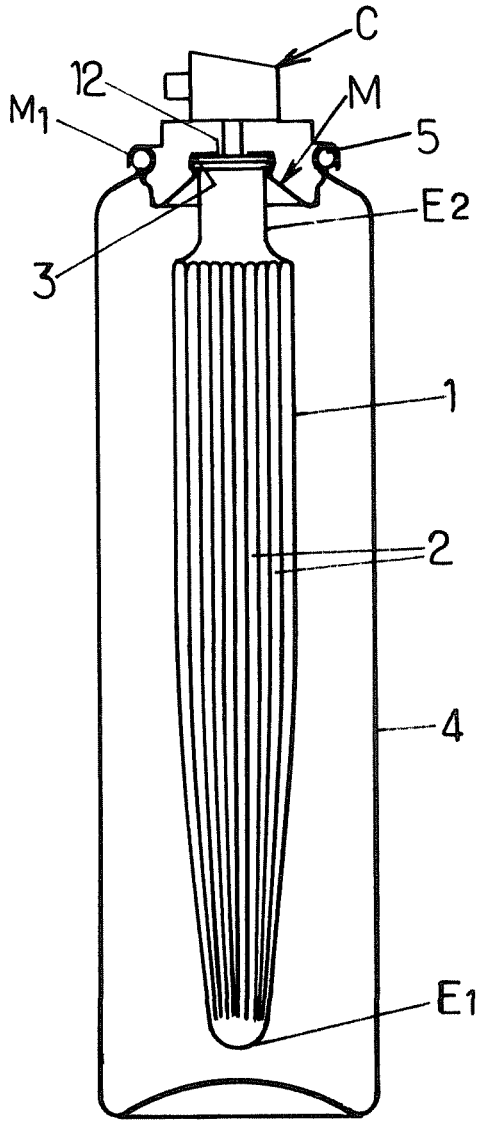

| | | | | |
|---|---|---|---|---|
| 5,622,282 | A | 4/1997 | Yazawa et al. | |
| 6,196,275 | B1 | 3/2001 | Yazawa et al. | |
| 6,439,430 | B1 | 8/2002 | Gilroy, Sr. et al. | |
| 6,651,847 | B2 * | 11/2003 | Mekata et al. | 222/105 |
| 7,455,195 | B2 * | 11/2008 | Mekata | 222/94 |

FOREIGN PATENT DOCUMENTS

| | | | |
|---|---|---|---|
| FR | 2 882 037 | A1 | 2/2005 |
| WO | WO 98/43882 | | 10/1998 |
| WO | WO 01/89956 | A2 | 11/2001 |

* cited by examiner

FLUID DELIVERY DEVICE

The invention relates to a device of the type used to deliver fluids, in particular medicinal fluids, under pressure.

In many industrial sectors and notably in those of medicines and cosmetic products, it is necessary to deliver under pressure, fluids and principally liquids containing medicinal substances or cosmetics, or products consisting of natural products possibly modified or adapted, thus permitting utilisation of these fluids.

For example, isotonic sea water, which has applications in particular for the washing of the nasal fossae, is one of these fluids.

There exist already devices of the type in question whose characteristics are disclosed in the U.S. Pat. Nos. 4,387,833, 4,423,829, 5,927,551 and 4,964,540.

In the case of these devices which can be operated in all positions, and even in the inverted position, the fluid is delivered, not by the action of a propellant gas, but under the action of a mechanical constraint, which is exerted on a container which is in the form of a pouch or flexible receptacle of variable volume and of generally cylindrical shape with longitudinal pleats, filled with the fluid to be delivered.

Still in the case of the devices disclosed in the above U.S. patents, the mechanical constraint, under the action of which the liquid contained within the receptacle of variable volume is delivered under pressure, is exerted by a cylindrical sleeve of elastic, especially rubber material with particular elastic properties which envelops the receptacle in the form of a pouch or flexible container and whose diameter is slightly larger than the diameter of the receptacle of variable volume when the latter is empty.

The sleeve in question is placed onto the receptacle of variable volume, and the fluid to be delivered is introduced under pressure into the receptacle which expands against the contrary action of the elastic sleeve of which the compression force exerted on the receptacle increases with the expansion of the receptacle due to the filling with the fluid to be delivered.

The receptacle in the form of a pouch or flexible container is equipped with an actuator which permits activating a valve to deliver the fluid, the whole being arranged inside a classic receptacle or container of the type used in the aerosol industry, notably in cosmetics or in personal care products.

These devices, which are very robust, have always given complete satisfaction to users but are penalised by their manufacturing cost due to the price of the rubber sleeve which forms part of their constitution.

Other devices of the type in question exist, wherein a cylindrically shaped receptacle of variable volume without pleats, intended to be filled with the fluid to be delivered, and also equipped with an actuator adapted to activate a valve to permit the fluid tinder pressure to be delivered, is located inside an external receptacle capable of resisting elevated pressures, notably in excess of 20 Bars; this external receptacle is filled with a neutral gas under pressure, the receptacle of variable volume being put in place and then the latter is filled with the fluid to be delivered, this fluid being introduced under a pressure which is sufficient to overcome the pressure exerted on the receptacle by the neutral gas with which the external receptacle is filled, which has as a consequence to increase still further the pressure of the neutral gas.

In the case of these devices, the constraint exerted on the internal receptacle of variable volume, and under the action of which the fluid under pressure may be delivered, is therefore of pneumatic nature.

These devices have not known a success comparable to those disclosed above, notably by reason of their fragility in case of impact or by falling, notably at the level of the connection between the receptacle of variable volume and the valve whose operation permits the product under pressure to be delivered.

Still other devices of the type in question have been disclosed in Offenlegungsschrift DE-OS 2 304 538, in U.S. Pat. No. 4,969,577, in U.S. Pat. No. 5,219,006, in U.S. Pat. No. 5,505,289, in U.S. Pat. No. 5,388,716, in U.S. Pat. No. 6,345,739, in EP 0 718 213 and in CH 678 614.

The devices disclosed in DE-OS 2 304 538 also comprise a receptacle of variable volume intended to be filled with a fluid to be delivered and located inside an external receptacle; the receptacle of variable volume is first introduced in the external receptacle, then filled with the fluid to be delivered and then the volume between both receptacles is filled with a gas under pressure under the action of which the fluid contained in the receptacle with variable volume can be delivered.

The receptacle with variable volume comprises, as appears from the figures and the corresponding parts of the specification of the DEOS, a cylindrically shaped part terminated by an upper and a lower extremity both conically shaped; the cylindrically shaped part comprises longitudinal pleats parallel to the axis of the receptacle, the upper conical extremity comprises converging pleats inclined towards the axis at its upper extremity which thus form a truncated cone and the lower extremity also comprises converging pleats inclined to the axis of the receptacle so as to form a concave conical bottom.

However, the thus conceived internal receptacle of variable volume is practically impossible to manufacture and even if it could have been manufactured its proper "folding" when emptying would become quite impossible due to the presence of the conically oriented pleats at its upper and lower extremities.

The invention has for object, above all, to remedy the inconveniences of the prior art and to provide the user with a device of the type in question which is free from the inconveniences presented by those which already exist.

It is to the merit of Applicants to have found that, surprisingly and unexpectedly, this objective is achieved by the hereafter defined device of the type in question.

This device, according to the invention and adapted to deliver fluids, notably medicaments, under pressure, is characterised by the fact that it comprises an internal receptacle of variable volume in the form or shape of a pouch or flexible container of generally cylindrical shape comprising a lower closed extremity and an upper open extremity comprising an extension, the said receptacle which comprises no other opening and which is slightly conical (angle on the apex lower than 5°) in direction of its lower extremity comprising pleats which are exclusively longitudinal and which extend from the upper to the lower extremity, the said receptacle which is intended to contain the fluid under pressure to be delivered being equipped with an actuator permitting to open a valve to enable the aforementioned fluid to be delivered, the said actuator being comprised by a mounting cup comprising a circular external edge or rim and only one concentric circular axial opening by which it is fixed through crimping on the upper extremity of the internal receptacle, the whole being located inside an external receptacle capable of resisting to an elevated internal pressure which is notably superior to 20 bars, said external receptacle which is of general cylindrical shape and which comprises a lower closed extremity and an upper extremity comprising a circular opening which is the only opening of the external receptacle, the said opening being demarcated by a circular rim or edge on which is fixed by crimping the external edge of the mounting cup, the internal and the external receptacles delimiting between them a variable volume which is filled with air or with a neutral gas under a pressure sufficient to exert on the internal receptacle of variable volume a pneumatic constraint sufficient to permit the delivery of the therein contained fluid when the above-said valve permitting the said delivery is operated by the aforementioned actuator, the said internal receptacle comprising no further opening permitting feeding therein the fluid to be delivered and neither the external receptacle nor the mounting cup comprising a further opening permitting filling with air or neutral gas the volume comprised between the internal and the external receptacle.

The external receptacle of the device according to the invention being intended to contain a gas under pressure, it should be capable of resisting to a pressure higher than 5 bars, preferably higher than 8 bars, more preferably higher than 12 bars and possibly be even capable of supporting pressures in excess of 20 bars.

In the case of a particular embodiment, the receptacle of variable volume, containing the fluid to be delivered and the external pressure resisting recipient are of transparent materials, allowing the user to see the fluid and to determine at every moment the state of filling of the device. Furthermore, any alteration of the fluid which may lead to a change in the aspect of the latter (colouring, separation of phases, etc.) can be detected by the user.

The invention concerns also other features which are preferably used at the same time and which will be more explicitly discussed hereafter.

Figure 2:
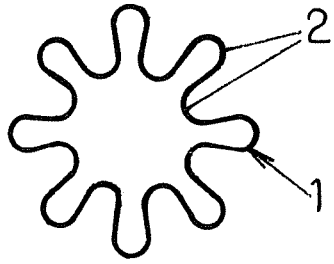
Figure 3:
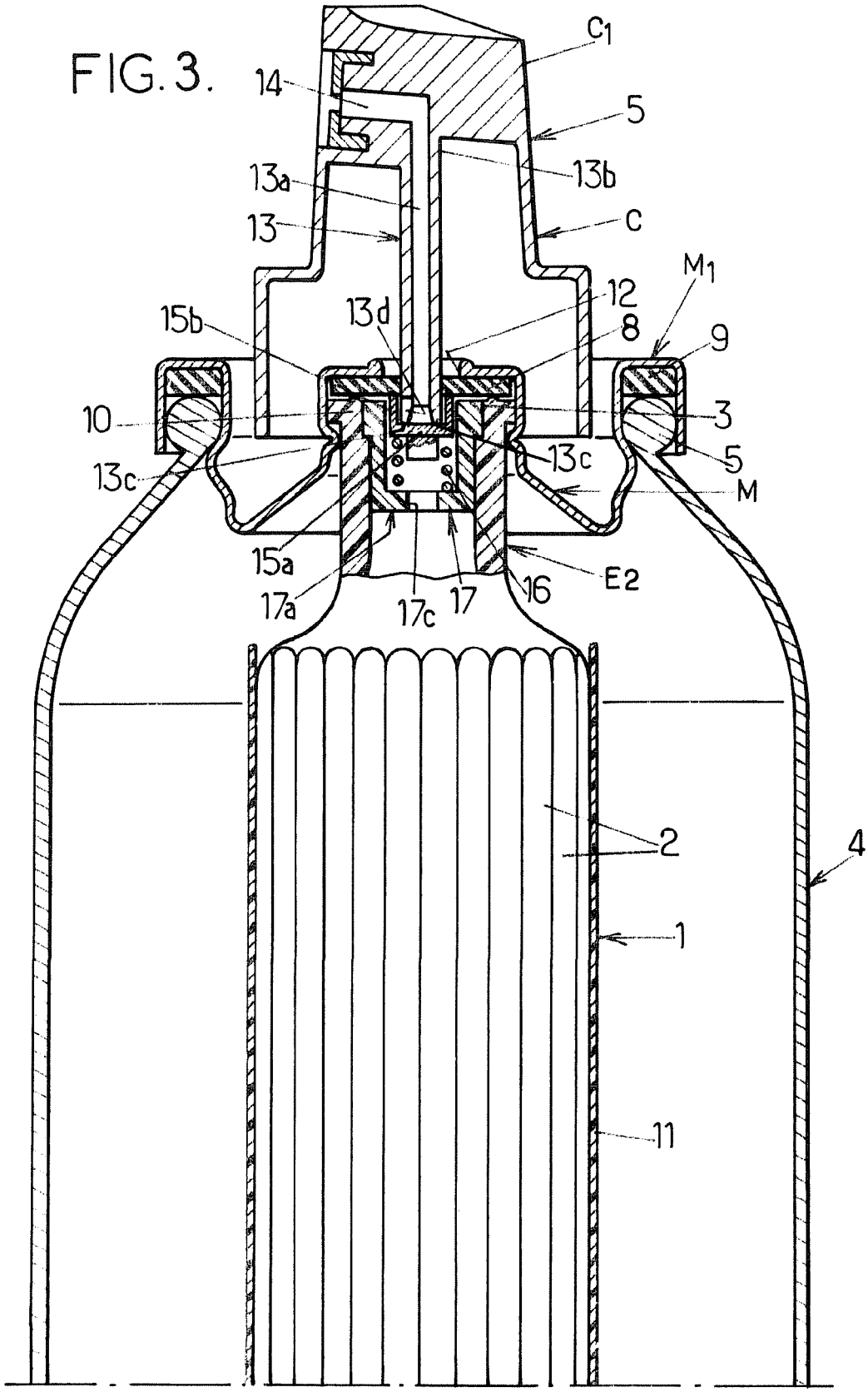
Figure 5:
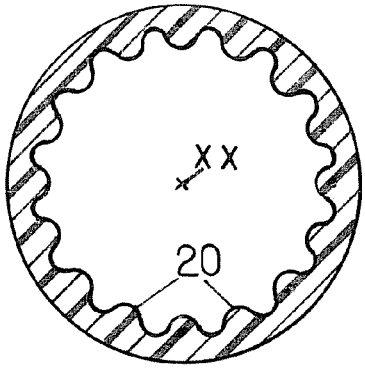
Figure 6:
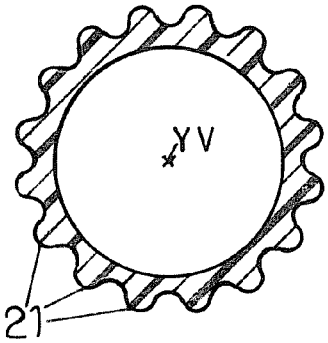
Figure 7:
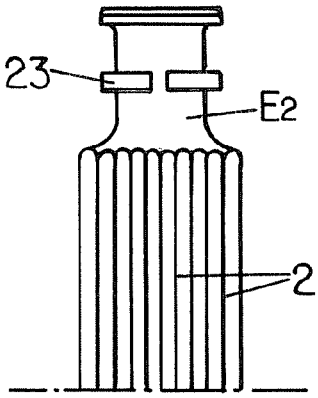

And the invention will be better understood with the help of the description which follows and which is relative to advantageous embodiments illustrated by the drawings in which:

FIG. 1 is an external schematic view in elevation of a device according to the invention, FIG. 2 is a view in section on a larger scale in accordance with 2-2 of FIG. 1, FIG. 3 is a partial view in section on a larger scale of the device according to FIG. 1, FIGS. 4, 5, 6, 8, 9, 10 and 11 are views in section and FIG. 7 is an outer view of advantageous embodiments of the invention.

As shown in FIGS. 1 and 2, the device according to the invention comprises

- a receptacle 1, designated as a whole by 1, in the form of a pouch or flexible container of variable volume, of generally cylindrical shape, with longitudinal pleats or ribs 2, closed at one of its extremities E1 and presenting at its opposite extremity an opening having an edge 3 carried by a cylindrical extension $E_2$,
- an also cylindrical external receptacle 4 comprising an opening 5 and inside of which is located the receptacle 1,
- a mounting cup or sleeve designated as a whole by M connecting one to the other the receptacles 1 and 4 which comprises a rim M1 and a concentric circular axial opening comprising an edge 12,
- a command or actuator designated as a whole by C, arranged on the opening of the receptacle 1,
- the mounting cup M being crimped by its rim $M_1$ onto the edge 5 of the receptacle 4, and by its central part which comprises the axial opening comprising the edge 12 on the extension $E_2$ close to the edge 3.

The recipient 1 may be advantageously made of polyethyleneterephtalate (PET) or of any other material offering analogous properties, For its manufacture, one may have recourse to the methods disclosed in the four U.S. patents identified above and, more particularly in U.S. Pat. No. 4,387,833 from column 3, line 63 to column 4, line 16.

During this manufacturing method, the mounting cup M, advantageously manufactured in aluminum or in tinplate (steel bearing a coating of tin on each face), is crimped onto the rim 3.

Standard mounting cups existing in commerce, are advantageously used, especially those having a mounting diameter of 25.4 mm, in order to permit the use for the constitution of the external receptacle 4, the receptacles intended for aerosols also available on the market, in particular those whose opening delimited by the opening 5 presents an internal diameter of 25.4 mm, the aforesaid mounting cup being crimped onto the edge 5.

The receptacles 1 and 4 are advantageously made of aluminum, polyethyleneterephtalate, or tinplate, or of any other synthetic material offering analogous properties.

In particular, the receptacles 1 and 4 may each be realized using laminated materials wherein at least one of the constitutive layers confers to the laminate sufficient mechanical resistance, while another layer may confer the properties of a barrier to gas, in particular to oxygen, nitrogen and/or carbon dioxide, and/or while still another layer may confer the properties of chemical resistance to the product to be delivered.

A layer proper to confer good mechanical resistance may for example be consisting of polyethylene terephtalate or PET.

A layer proper to confer good gas barrier properties may for example be realized in Nylon, especially Nylon MXD6, in resin ethylene vinyl alcohol (or EVOH), or in silicium oxide.

A layer proper to confer good properties of chemical resistance may for example, also be constituted in polyethylene terephtalate.

Accordingly, the receptacle 1 may be constituted in a laminate of the type PET/Nylon/PET, that is to say comprising an external layer of polyethylene terephtalate, an intermediate layer of Nylon and an internal layer, that is to say a layer intended to be in contact with the fluid to be delivered, also of polyethylene terephtalate; it may also be realized in a laminate of the type PET/EVOH/PET.

A material of the type PET/Nylon/PET presents the additional advantage of being transparent; consequently, it is especially useful and indicated when it is used in connection with the particular embodiment already mentioned and in the case of which the internal receptacle of variable volume and the external receptacle are made of transparent materials.

The receptacle 4 may be realized in the same material. However, bearing in mind that the material constituting this receptacle is not in contact with the fluid to be delivered, it is possible to use a bilayer laminate, for example in polyethylene terephtalate and Nylon.

A material of this type which does not comprise an internal layer conferring chemical resistance may also be employed for the constitution of receptacle 1 provided the fluid to be delivered is chemically compatible with the other layers.

Such laminates may be realized by the employment of techniques of co-extrusion or co-injection with the use of technologies such as those developed by the company KORTEC Inc. Ipswich, MA01938, USA or for example: NISSEI ASB Machine Co., Ltd. 4586-3 Koo Komoro-shi, Nagano-ken 384-8585, Japan.

It is also possible to contemplate deposit of a layer, for example of silicium oxide using the technique of vapour deposition. The layer so deposited may be extremely fine of only a few microns in thickness. The technology to be employed is, for example, that developed by the company SIG Corpoplast Inc., under the name PLASMAX.

Such a layer may be deposited on a classic monolayer material, or on a laminate obtained by co-extrusion or by co-injection.

According to the especially advantageous embodiment here-above mentioned, the internal and external receptacles, respectively 1 and 4 of the fluid delivery device according to the invention are made of a synthetic transparent material.

It has also here-above been indicated that, in this particular embodiment, the user has the possibility to know at any moment the amount of fluid to be delivered, which remains still available inside the internal receptacle 1.

The volume of the latter, when emptying, decreases under the influence of the thereon exerted pneumatic effect, due to which the therein contained fluid is delivered.

Now, the "folding" of the internal receptacle, when emptying, shows a tendency to occur in a more or less "anarchistic" manner which may result in an uneven or more or less twisted shape of the internal receptacle once "folded".

Essentially, from an esthetical point of view, such an anarchistic folding should be avoided as, due to the transparency of the external receptacle 4, the irregular deformation of this internal receptacle 1 as the delivery of the therein contained fluid proceeds is visible to the user.

To overcome this drawback, the invention provides two solutions, each of which is implemented at a different step of the manufacture of the internal receptacle 1.

This receptacle of variable volume in form of a pouch of generally cylindrical shape with exclusively longitudinal pleats is prepared in two steps, respectively step A and step B.

During the first step or step A, which comprises the preparation of the receptacle of variable volume in the form of a pouch or container of generally cylindrical shape, the wall of the said receptacle is flat or even and during the second step or step B, the said wall is provided with the longitudinal pleats 2 which are shown, in particular, on FIGS. 1 and 2.

Figure 4:
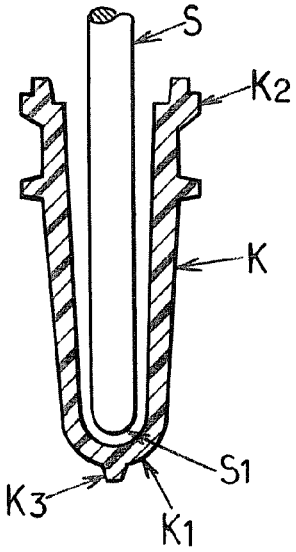

In that respect, recourse is made to a rough shape or preform K (prepared by injection inside a first mould or form) shown in axial section on FIG. 4 and made of the synthetic material of the receptacle to be prepared; the said rough shape has the shape of a cylindrical tube closed at its extremity K1 and opened at its other extremity K2, the said cylindrical tube being slightly conical (angle on the apex or summit from 1° to 5°), the apex of the cone at the level of K1 comprising a protuberance K3; protuberance K3 is designated by the word "gate" and corresponds to the point of introduction under pressure of the fluent synthetic material into the mould.

The said rough shape K is transferred by indexation into a second mould in view of the abovesaid first step or step A of the preparation of the internal receptacle. Inside the second mould, the said rough shape is subjected to a mechanical elongation which is carried out using an element S of the stylet type, introduced through the opening of the rough shape and whose extremity S1 exerts an axial mechanical effect on the bottom of the rough shape at the level of its extremity K1. It is important that the protuberance K3 moves along the axis under the action of the stylet in direction of the centre of the bottom of the blowing mould; the said mechanical elongation is combined with a moulding by blowing inside the second mould according to the process designated by the expression "stretch blow"; the said second mould has the form and the dimensions which permit the direct obtention of the pouch or container of generally cylindrical shape which constitutes receptacle 1 which, at that stage, does not yet include the longitudinal pleats 2.

More particularly, in order to manufacture the pouch or container of generally cylindrical form, a pressure is exerted on the bottom of the rough shape by way of the above-mentioned stylet, extending thus the rough shape in direction of the bottom of the mould. That operation ensures the centring of the bottom of the rough shape with the mould, the important result being that the rough shape is coaxially arranged with the mould.

That operation is designated by the technical expression "to plant the gate", which means that the rough shape remains coaxial with the second mould. Once the prolongation of the rough shape has been obtained under the action of the stylet, it is possible to introduce compressed air under high pressure (in the order of 12 to 25 bars) into the rough shape.

Under the effect of the pressure exerted by the compressed air, the rough shape extends or expands in all directions. The extension or expanding of its constituting material, which is advantageously consisting of polyethylene terephtalate or PET, is accompanied by an increase of its resistance to rupture; as a result of that extension or expanding, the wall of the receptacle becomes thinner. That technique is designated by the expression "stretch-blow".

The technical elements used in that first step or step A, i.e. the element which is used for the mechanical elongation as well as the second mould which enables to carry out the moulding-blowing or injection moulding, are marketed especially by the company NISSEI ASB Company, 125 Westlake Parkway, Suite 120, ATLANTA, Ga. 30336 USA.

As hereabove indicated, when manufacturing the internal receptacle 1 by way of the technique called "strech-blow", the constituting material of which being polyethylene terephtalate or PET, the extension or expanding of the latter is accompanied by an increase of its resistance to rupture.

Before describing the second step or step B, it is necessary to deal with the problem related to the fact that increase of the resistance to rupture of the wall of receptacle 1 does not occur or at most at a lower degree at the level of the extension E2 which is less and even not subjected to the forces resulting from the "stretch blow".

As a consequence thereof, extension E2 is likely to experience problems of plastic flow or deformation in the case its temperature reaches 50 to 55° C., which problems might be detrimental to tightness.

In order to obviate these difficulties, it is possible

- either to use a reinforcing collar or sleeve which may be positioned at the extremity of extension E2 against either the inner or the outer surface of the constituting wall of E2
- or to manufacture at least part of extension E2 using a material different from PET and having a better resistance as PET to temperatures of 50 to 55° C. or more, for instance Nylon 66.

Figure 9:
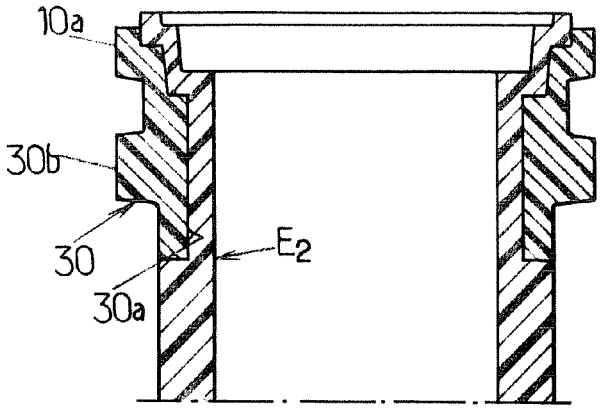

An advantageous embodiment of the first solution, i.e. the recourse to an outer reinforcing collar or sleeve is shown in FIG. 9, which shows in section extension E2.

According to that embodiment, an outer reinforcing sleeve 30, for instance made of Nylon 66 or Acetal copolymer, is positioned around the extremity of extension E2, its shape in section being such that its inner surface 30*a* is complementary to that of the outer surface of E2, and that it outer surface 30*b* permits the fixation by crimping of mounting cup M; that outer surface has a configuration which comprises a neck 10*a* analogous to neck 10 shown in FIG. 3.

From the practical point of view, sleeve 30 is manufactured separately; if an Acetal copolymer is used, it may be that marketed under the trademark CELCON M90, manufactured by Ticon Inc., 8040 Dixie Highway, Florence, Ky. 41042, USA.

In a first step, sleeve 30 is positioned inside an especially adapted mould comprising a housing to receive sleeve 30 and, in a second step, receptacle 1 is produced through injection of PET into the mould using the technique called "injection-stretch blow".

The thus equipped receptacle 1 does not undergo deformations at the extremity of extension E2 when heated to temperatures of from 50 to 55° C. or higher.

Figure 10:
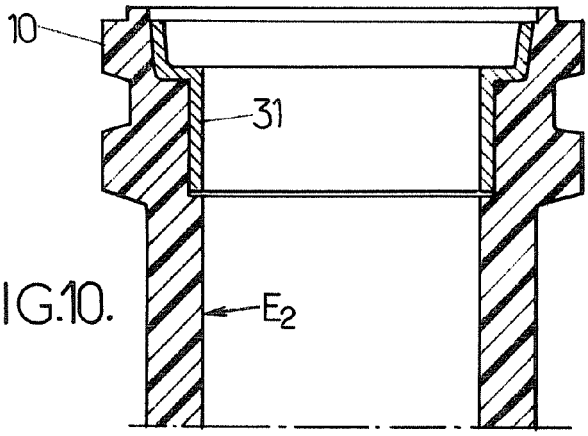
Figure 11:
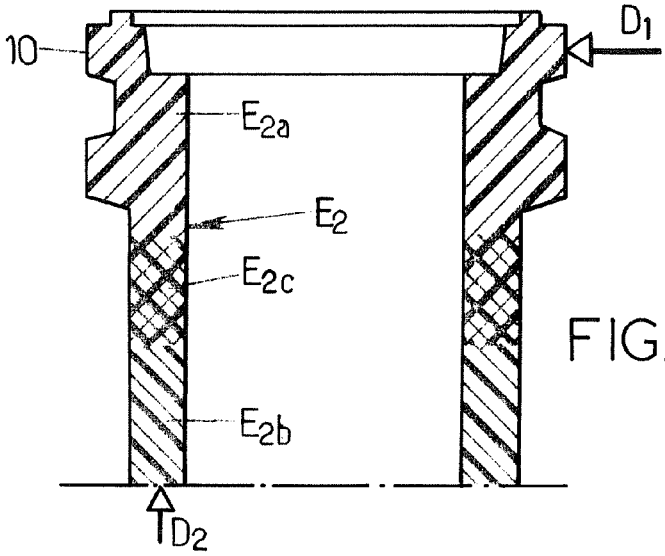

According to a further advantageous embodiment of the first solution, recourse is made to an inner reinforcing collar or sleeve 31 shown on FIG. 10.

Such an internal reinforcing sleeve can be made of a stainless metal, for instance AISI 316, and may be produced by stamping.

As appears from FIG. 10, the shape of sleeve 31 is complementary to that of the inner surface of extension E2, the outer surface of which comprises an edge 10 already shown FIG. 3 which permits fixation by crimping of mounting cup M.

The positioning of sleeve 31 inside extension E2 may be performed by positioning it inside the rough shape used for the manufacture of receptacle 1, the said rough shape being positioned inside the mould used for manufacturing receptacle 1 using the technique called "stretch blow".

Proceeding thus, sleeve 31 becomes a constituting part of extension E2.

It is also possible to introduce sleeve 31 into extension E2 under mechanical or pneumatic pressure.

That way of proceeding makes it necessary to produce sleeve 31 with a shape that matches exactly the configuration of the internal surface of extension E2.

It is possible to adapt the shape of the respective parts in such a way that tightness between the extremity of extension E2 and the valve is ensured.

According to the abovementioned second solution, the material from which is made extension E2 or at least part of said extension, is different from the material used for making receptacle 1 proper.

From a practical point of view to render possible the use of two different materials, the mould used for the production of receptacle 1 through the "stretch blow" technique is equipped with two devices for the plastic material injection; one of these devices, denoted D1, is located at the end of extension E2 and is used for injecting a heat resistant material, for instance Nylon 66; the thus obtained part of E2 is denoted E2*a*.

The second device, denoted D2, is located still inside the mould, at the level of the limit between connection of receptacle 1 proper and extension E2; this device is used for injection by "injection-stretch blow" technique of the material constitutive of receptacle 1, for instance PET; the thus obtained part of E2 is denoted E2*b*.

The area where the Nylon 66 material of extension E2 and the PET material of receptacle 1 are in contact and more or less mixed, is called "transition zone" and denoted E2*c*.

A further method for avoiding the drawbacks of deformation of extension E2 under heat influence, consists in preparing extension E2 from PET with oversized dimensions, subjecting the thus established extension E2 to a heat treatment under controlled time and temperature conditions, which treatment achieves the contemplated stabilization and at the end of which extension E2 acquires through shrinking the requested dimensions which permit insertion in and fixation of receptacle 1 by crimping through mounting cup M on receptacle 4 as disclosed.

Now, during the second step or step B of the manufacture of the internal receptacle 1, the generally cylindrical pouch or container, whose wall at that stage is still even, is provided with the exclusively longitudinal pleats 2, which are shown on FIGS. 1 and 2 using for example a device of the kind of those, which are disclosed in U.S. Pat. No. 4,701,120 more especially from line 50, column 1 to line 30, column 2.

That device comprises the elements which are designated by the word "palettes" or blades and which permit to provide the wall of the pouch or container of generally cylindrical shape with the longitudinal pleats.

In order to avoid any anarchistic "folding" of the internal receptacle 1, as a consequence of the use of the fluid delivery device and in order to ensure that the said folding occurs in such a way that, when the totality of the fluid to be delivered has been blown out, the receptacle resumes the shape which it had before the introduction of the fluid to be delivered, it is proceeded as follows according to the invention or along an equivalent way.

According to a first embodiment, the pleats 2 of receptacle 1 are realized in two steps: the first step consists to provide receptacle 1 with rough ribs or pleats.

In that first embodiment, recourse is made during the first step or step A to a mould, which is different from those used in the prior art by the fact that the internal surface of its wall (against which is applied during blowing the constituting material of the receptacle 1 to be manufactured), comprises longitudinal pleats 20, whose shape appears on FIG. 5, which shows the mould used for moulding-blowing in sectional view perpendicular to its axis XX; the longitudinal pleats 20 comprised by the internal surface of the wall of the mould and which provide the wall of the pouch or container of variable volume and of generally cylindrical shape constitutive of receptacle 1, with exclusively longitudinal pleats 21, which are rough shapes of the pleats 2 to be conferred to the pouch are shown on FIG. 6, which is a sectional view perpendicular to the axis YY of the pouch or container of variable volume once extracted from the mould and before it is introduced into the device used to elaborate the definite pleats 2 said device being used during the second step or step B.

That device used during the second step, may be the one disclosed in U.S. Pat. No. 4,701,120.

The number of rough shapes 21, which is generally equal to 16, must be the same as the number of "palettes" or blades comprised by the device used during the second step or step B, the said blades enabling to provide the receptacle 1 with the definite longitudinal pleats 2.

Here a difficulty arises in connection with orientation and positioning.

It is necessary that the 16 rough shapes 21, comprised by the pouch or container of variable volume obtained at the end of the first step or step A, coincide with the parties of the device used during the second step of step B whose "palettes" or blades provide during the said step B the pouch or container with the definite pleats 2.

In order to permit the positioning of the pouch or container of variable volume obtained at the end of the first step or step A, at the moment it is introduced in the device used during the second step of step B, in other words, to put in line the rough shape pleats 21 comprised by the pouch or container of variable volume at the end of the first step or step A, with the parties of the device used during the second step or step B, which comprise the "palettes" or blades which cooperate to realize the definite pleats 2, the extremity E2 of the pouch or container of variable volume may be provided with a notched support ring 23 shown on FIG. 7, which notched support ring permits the obtention of the contemplated positioning, procedure being as follows.

The said notched support ring 23 permits to transport the pouch or container of variable volume inside the mechanism, which dispatches it in direction of the folding head at the level of which are realized the pleats 2 starting from the rough shape pleats 21, previously formed due to the conformation of the internal wall of the blowing mould.

It is possible to consider a mechanism comprising a clic or abutment operated under the action of a spring in such a way that at the moment at which the clic or abutment is positioned at the level of the notch of the notched support ring, it penetrates in the said cutting and blocks the rotation of the pouch or container of variable volume, thus ensuring the contemplated positioning.

In order to cause the rotation of the pouch or container of variable volume, it is possible to contemplate that the bearing part or support, which maintains the pouch of variable volume inside the "bottle holder", is arranged in such a way that it permits the said rotation under the action of a pneumatic rotative motor which, under the action of an actuator, rotates the said pouch or container while inside the "bottle holder" until the position at which the clic or abutment plunges into the cutting of the split ring to stop the pouch or container in the requested position.

It becomes thus possible to obtain that the rough pleats 21, with which the pouch or container of variable volume had been provided during the moulding by blowing, are put in line with the "palettes" or blades of the device used during step B.

It is a consequence of the here-above described manufacturing procedure of the internal receptacle 1 which procedure comprises the stage of realization of the rough pleats 21 before the realization of the definite pleats 2, that the folding of receptacle 1 proceeds in such a way that it retakes its initial shape after the consumption of the totality of the fluid to be delivered.

Figure 8:
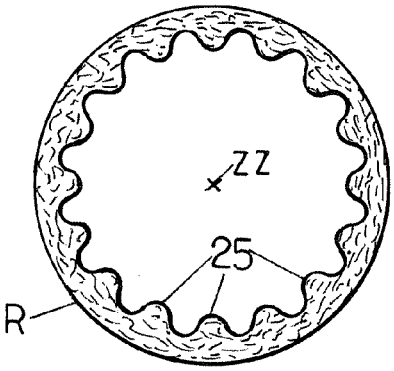

According to a second embodiment permitting to obtain a uniform folding of the pouch or container of variable volume during the use of the fluid delivery device in such a manner that, once empty, the said pouch or container retakes its initial shape, which is the one it has at the end of the second step or step B, a cylindrical sleeve R is positioned on receptacle 1 comprising the longitudinal pleats 2, the said sleeve R being shown on a sectional view perpendicular to its axis ZZ in FIG. 8; the said sleeve R is made of an elastical synthetic material which is transparent and which comprises at its internal surface rough longitudinal pleats 25 which are parallel to axis ZZ the number of which is the same as the number of longitudinal pleats 2 comprised by receptacle 1 of variable form in such a way that each of the rough pleats comprised by the cylindrical sleeve R position itself between two pleats 2 of the pouch or container of variable volume 1.

The sleeve R is permanently maintained on receptacle 1.

In order to ensure the positioning, when being put in place, of sleeve R, with respect to the pouch or container of variable volume 1, it is again possible to use a notched support ring of the same type as ring 23 disclosed with respect to the first embodiment the said notched support ring being positioned at the open extremity of the pouch or container of variable volume 1, as shown in FIG. 7.

Concerning the positioning proper, the procedure is the same as here-above disclosed with respect to the first embodiment.

Due to the presence of sleeve R, the folding of receptacle 1 is going on in a regular manner, receptacle 1 retaking its initial shape once the totality of the fluid to be delivered has been used.

FIG. 3 shows in detail the constitution parts of the device of the invention according to the present advantageous embodiment.

This figure shows the constitutive parts which have already been disclosed in connection with the schematic views of FIGS. 1 and 2.

As appears from FIG. 3, the tightness on the one hand on the level of the crimping of the mounting cup M on the extension $E_2$ close to rim 3 of the opening of the receptacle 1, is made sure by a gasket 8 consisting of elastomeric material, in particular rubber, and on the other hand, at the level of the crimping of the same mounting cup on rim 5 of the opening of receptacle 4 by a gasket 9 consisting of same material of a material as gasket 8.

It is also possible to contemplate elimination of the gasket 9 when the receptacle 4 is realized in a material presenting sufficient elastic characteristics, for example in polyethylene terephtalate or in any other analogous synthetic material. The tightness of the package will then be made sure directly when realizing the crimping between rim 5 of the receptacle and the mounting cup M by virtue of the elastic properties of the material. The absence of the gasket permits a reduction in cost.

The crimping of the mounting cup M on the extremity of the prolongation or extension $E_2$ of the receptacle 1 is rendered possible by an external edge or return provided at its extremity.

It is possible that the receptacle 1 is surrounded by a cylindrical sleeve 11 which is advantageously manufactured from a synthetic material, in particular polyvinylethylene and whose function is to protect the receptacle 1.

The mounting cup M is provided with a concentric circular opening whose edge is shown in 12.

The command or control C, which has the shape of an actuator button, has the general lines of a sleeve in the shape of a hat, as shown in FIG. 3, and is advantageously made in a rigid synthetic material, notably in high density polyethylene; it includes an axial tube 13 with an axial passage 13*a* which on the one hand communicates at its upper extremity 13*b* with a tube 14 located in the upper part $C_1$ of the command and connected to tube 13 and which on the other hand opens by its lower extremity 13*c*, when it is positioned as shown in FIG. 3 on the device of the invention, in the part $E_2$, of the receptacle 1 through the opening 12 of the mounting cup M, the gasket 8 being arranged in such a way that it also ensures the tightness with tube 13 as shown.

The command or control C is therefore arranged and secured on the extremity $E_2$ of the receptacle 1 due to the arrangement of the tube 13 in the opening comprising edge 3 of receptacle 1 as shown.

The extremity 13*c* of the tube 13 rests on a valve constituted of an element in the form of a cup comprising a base or bottom 15*a* and a wall 15*b*; at its extremity 13*c* the tube 13 includes an opening or notch 13*d*.

In the closed position—under the action of a spring 16 arranged between the base 15*a* and a return 17*a* of an element 17 in the form of a socket secured inside the end of the extremity $E_2$—the bottom 15*a* is pushed against the extremity 13*c* of tube 13 and the free edge of the wall 15*b* of the cup is pushed against the sealing gasket 8.

Element 17 comprises an axial passage 17*c* to ensure communication of the interior of receptacle 1 with the interior of the space delimited by element 17.

To deliver the fluid under pressure contained within receptacle 1, it is sufficient to exert on command C in the direction of the receptacle 1, a pressure higher than that with which the spring 15 applies the bottom 15*a* of the valve cup against the extremity 13*c* of tube 13 which has the effect of distancing the free edge of the wall 15*b* from the sealing gasket 8.

The fluid under pressure contained within receptacle 1 may therefore pass between the free edge of the wall 15*b* and the sealing gasket 8 towards the inside of the cup and by the notch 13*d* provided at the extremity 13*c* of tube 13 into the axial passage 13*a* and then by the passage 14 towards the exterior under the form required.

To assemble the device according to the invention, it may be proceeded as follows:

The receptacle 1, upon which has been secured the mounting cup M after the positioning of gasket 8, is preferably drained of most of the air which is contained therein.

The whole is then attached, after the positioning of gasket 9 by crimping on the external receptacle 4 in which therefore is arranged the receptacle 1, before introduction into the volume comprised between the wall of receptacle 4 and the external surface of receptacle 1, of air or neutral gas under pressure in a quantity sufficient for bringing the pressure to a value preferably comprised between about 1.5 and about 3.5 bars, the precise value of the said pressure being chosen in accordance with the nature of the fluid to be delivered.

In view of introduction of the neutral gas, one may proceed as follows using a suitable tool, for example an under the cup gasser crimper of the type marketed by the company Pamasol Willi Maeder A G, Driesbuelstrasse 2, CH-8808 Pfaffikon, S Z Switzerland under the name "UTC Head". This tool permits to ensure the tightness at the level of the upper surface of the receptacle 4 and lifts slightly the mounting cup M, using a connection by vacuum to pull by aspiration the mounting cup into a seat, and to permit the introduction under pressure of a neutral gas or of compressed air. Once the gas has been introduced, the mounting cup M is pressed against the edge or rim 5 of the receptacle 4; then, a crimping is made between the cup M and receptacle 4. During this operation a pressure is maintained by the head to compress gasket 9 and therefore ensure a good tightness between the mounting cup M and the receptacle 4.

The receptacle 1 is then filled with the fluid intended to be delivered under pressure.

In that respect, it is possible to have recourse to a so-called metering unit, for instance that which is marketed by the company Pamasol Willi Maeder A G, Driesbuelstrasse 2, CH-8808 Pfaffikon, S Z Switzerland under the name "Remplisseuse volumétrique sous pression" (i.e. "Volumetric pressure-filling machine"). This quantity determining unit generally comprises a device for volumetric quantity determination under high pressure and a filling nozzle. Once the mounting cap M is crimped on receptacle 4, the whole is positioned under a filling nozzle which is comprised by the metering unit and the nozzle is operated to come down and to ensure tightness on the mounting cup. Tightness on the higher part 12 of the mounting cup is ensured by using an adapter and the fluid is introduced under pressure through valve 15 in order to fill receptacle 1.

Due to the increase in volume of receptacle 1 as a consequence of the introduction of the fluid, the pressure of the air or of the neutral gas comprised between the wall of receptacle 4 and receptacle 1 increases and reaches generally a value comprised between about 4 and about 10 bars, the precise selected value being a function of the nature of the liquid to be delivered.

Command or control C is then positioned and the device according to the invention is ready for use.

Consequently and whatever the selected embodiment of the device according to the invention, the features of the latter sufficiently result from the foregoing description, the said device presenting, with respect to those which already exist, a number of advantages among which, in particular, those of an elevated reliability, of a high robustness and of an interesting cost price.

The invention claimed is:

1. A gas-pressurized device adapted to deliver fluids under pressure, consisting essentially of:

an internal receptacle 1 of variable volume in a form or shape of a pouch or flexible container of generally cylindrical shape consisting essentially of:

a lower closed extremity E1 and an upper open extremity which is lengthened as prolongation E2, the said receptacle which has no other opening and which is slightly conical in direction of its lower extremity, further comprising pleats 2 which are exclusively longitudinal and which extend from the upper to the lower extremity, an actuator C housed on said internal receptacle, permitting to open a valve to enable the aforementioned fluid to be delivered, the said actuator comprising a mounting cup M comprising a circular external edge or rim $M_1$ and only one concentric circular axial opening 12 by which it is fixed through crimping on the prolongation E2 of the internal receptacle, an external receptacle 4 capable of resisting to an elevated internal pressure which is superior to 20 bars, said external receptacle which is of general cylindrical shape and which comprises a lower closed extremity and an upper extremity comprising a circular opening which is the only opening of the external receptacle, the said opening being demarcated by a circular rim or edge 5 on which is fixed by crimping the external edge $M_1$ of the mounting cup, a pressurized variable volume of neutral gas or air delimited between the internal and the external receptacles, wherein the variable volume of neutral gas or air is under a pressure sufficient to exert on the internal receptacle of variable volume a pneumatic constraint sufficient to permit the delivery of the therein contained fluid when the valve is operated by the actuator, wherein the said internal receptacle comprises no further opening permitting feeding therein the fluid to be delivered and neither the external receptacle nor the mounting cup comprise a further opening permitting filling with air or neutral gas the volume delimited between the internal and the external receptacle, wherein the leak tightness, at the level of the crimping by the concentric circular axial opening 12 of the mounting cup M on the prolongation E2, in a position close to the edge 3 of the opening of the internal receptacle 1, is ensured by a gasket 8 consisting of an elastomeric material, in particular rubber and, at the level of the crimping of same mounting cup M onto the rim or edge 5 of the opening of the external receptacle 4 by a gasket 9 consisting of the same material as gasket 8, or, when the external receptacle (4) is made in a material with sufficient elastic characteristics, without said gasket 9, the crimping of mounting cup M onto the extremity of the prolongation E2 of the internal receptacle 1 being made possible by an external return or edge 10 provided at its extremity.

2. The gas-pressurized device according to claim 1, wherein the internal receptacle 1 is made of polyethyleneterephtalate (PET) or of any other material offering analogous properties and wherein the mounting cup M which is crimped to edge 3 is consisting of aluminum or of tinplate (steel with a coating of tin on each side), the external receptacle 4 being made of aluminum, polyethyleneterephtalate or tinplate.

3. The gas-presurized device according to claim 1, wherein the leak tightness, at the level of the crimping of the mounting cup M on the prolongation E, in a position close to the edge 3 of the opening of the internal receptacle 1, is ensured by a gasket 8 consisting of an elastomeric material, in particular rubber and, at the level of the crimping of same mounting cup M onto the rim or edge 5 of the opening of the external receptacle 4 by a gasket 9 consisting of the same material as gasket 8, the crimping of mounting cup M onto the extremity of the prolongation E2 of the internal receptacle 1 being made possible by an external return or edge 10 provided at its extremity.

4. The gas-pressurized device according to claim 1, wherein the actuator C, which has the form of an actuator button having the general lines of a sleeve in the shape of a hat, which is made of a rigid synthetic material, and includes an axial tube 13 with an internal axial passage 13*a*, which on the one hand communicates at its upper extremity 13*b* with a conduit 14 located in the upper part $C_1$ of the actuator and connected to tube 13 and which, on the other hand opens by its lower extremity 13*c* when it is positioned on the device, in the part E2 of the internal receptacle 1, passing through the opening 12 of the mounting cup M, gasket 8 being arranged in such a way that it also ensures the leak tightness with tube 13, the said actuator C being arranged and secured on the extremity E2 of the internal receptacle 1 due to the arrangement of the tube 13 in the opening 3 of the internal receptacle 1, the extremity 13*c* of tube 13 applying load onto a valve consisting of an element in the form of a cup comprising a base or bottom 15*a* and a wall 15*b*, tube 13 being provided at its extremity 13*c* with an opening or notch 13*d*.

5. The gas-pressurized device according to claim 1 wherein, in the closed position under the action of a spring 16 arranged between the base or bottom 15*a* of a valve and the return or edge 17*a* of an element 17 in the form of a socket secured inside the end of the extremity E2, the bottom 15*a* of the valve is pushed against the extremity 13*c* of tube 13 and the free edge of the wall 15*b* is pushed against a sealing gasket 8, element 17 comprising an axial passage 17*c* to ensure communication of the interior of the internal receptacle 1 with the interior of the space delimited by element 17.

6. The gas-pressurized device according to claim 1 wherein the internal and external receptacles 1 and 4 are made of transparent materials.

7. The gas-pressurized device according to claim 1 wherein the internal receptacle 1 and the external receptacle 4 are realized using laminates composed of constitutive layers, wherein at least one of the constitutive layers confers to the laminate sufficient mechanical resistance, while another confers the properties of a barrier to gas, in particular to oxygen, nitrogen and/or carbon dioxide, and while still another layer confers the properties of chemical resistance with respect to the product to be delivered.

8. The gas-pressurized device according to claim 7, wherein:

the layer adapted to confer good mechanical resistance is consisting of polyethylene terephtalate or PET, the layer adapted to confer good gas barrier properties is realized in Nylon, especially Nylon MXD6, in ethylene vinyl alcohol resin (or EVOH), or in silicium oxide, the layer adapted to confer good properties of chemical resistance is consisting of polyethylene terephtalate.

9. The gas-pressurized device according to claim 7, wherein the internal receptacle 1 is realized either using a laminate of the PET/Nylon/PET type, which means that it comprises an external layer of polyethylene terephtalate, an intermediate layer of Nylon and an internal layer, intended to be in contact with the fluid to be delivered, of polyethylene terephtalate or using a laminate of a PET/EVOH/PET type, the external receptacle 4 being realized in the same material or in a bi-layer laminate, especially in polyethylene terephtalate and Nylon.

10. The gas-pressurized device according to claim 1 wherein the pleats 2 of the internal receptacle 1 are realized in two steps during the first of which the internal receptacle 1 is provided with rough pleats 21 which are obtained using a mould, the inner surface of the wall of which comprises only longitudinal pleats 20.

11. The gas-pressurized device according to claim 1, comprising a cylindrical sleeve R positioned on receptacle 1, the said sleeve R which is realized in transparent synthetic elastic material, comprising on its internal surface rough pleats 25, each of them being positioned between two pleats 2 of receptacle 1.

12. The gas-pressurized device according to claim 1 wherein the extension E2 comprised by the internal receptacle 1 is equipped with an internal reinforcing collar or sleeve 30 or with an external reinforcing collar or sleeve 31.

13. The gas-pressurized device according to claim 1 wherein at least a part of the extension E2 comprised by the internal receptacle 1 is made of a material resistant tot temperatures from 50 to 55° C. and even higher than 55° C.

* * * * *